US005209365A

United States Patent [19]

Wood

[11] Patent Number: 5,209,365

[45] Date of Patent: May 11, 1993

[54] PAINT CUP LID ASSEMBLY

[75] Inventor: Mark W. Wood, Jackson, Tenn.

[73] Assignee: DeVilbiss Air Power Company, Jackson, Tenn.

[21] Appl. No.: 938,630

[22] Filed: Sep. 1, 1992

[51] Int. Cl.[5] ..... B65D 41/56

[52] U.S. Cl. ..... 220/212; 220/293; 220/322; 239/600

[58] Field of Search ..... 220/315, 322, 293, 212; 239/289, 318, 337, 340, 600, DIG. 14; 81/3.15

[56] References Cited

U.S. PATENT DOCUMENTS 1,843,269 2/1932 Capser ..... 239/340

2,263,842 11/1941 Gross ..... 239/340

2,670,882 5/1954 Best ..... 220/322 X

*Primary Examiner*—Allan N. Shoap

*Assistant Examiner*—Nova Stucker

*Attorney, Agent, or Firm*—MacMillan, Sobanski & Todd

[57] ABSTRACT

An improved paint cup lid assembly of the type having a paint feed tube which is attached by a nut to a hand held paint spray gun. The paint feed tube is secured to a lid. The lid assembly includes a yolk which releasably secures the lid to a paint cup. When the paint cup is detached from the lid assembly, the yolk may be moved to a position wherein a socket formed in the yolk engages the nut and the yolk is used as a wrench for loosening or tightening the nut.

4 Claims, 3 Drawing Sheets

PAINT CUP LID ASSEMBLY

TECHNICAL FIELD

The invention relates to paint cups of the type attached to hand held paint spray guns and more particularly to an improved lid assembly for a paint cup which facilitates attaching the paint cup to and removing the paint cup and lid assembly from a hand held paint spray gun.

BACKGROUND ART

Hand held paint spray guns are commonly operated with an attached paint cup. Typically, a threaded nipple depends from the gun body adjacent a nozzle for receiving paint from either a paint cup or a pressurized paint supply hose. The paint cup has a lid assembly from which the cup is removable for filling and cleaning the cup. The lid assembly includes a lid for closing the top of the paint cup and a yolk which releasably engages pins projecting from opposite sides of the cup adjacent the top. When the yolk engages the pins, a lever actuated cam is rotated for locking the lid onto the cup. A paint feed tube secured to the lid extends from the bottom of the cup through the cam and the yolk and is secured by a nut to the paint gun nipple. Or, the lid assembly may be retained on the cup pins by other known means, such as by the force of a spring located between the lid and the yolk.

In many paint spray guns, the paint flows from the cup to the gun through suction feed. For successful suction feed, it is necessary to vent the paint cup to atmosphere. The vent is normally in the paint cup lid and must be designed and located to prevent dripping when the spray gun is tipped, for example, when painting a horizontal surface. Consequently, the orientation of the vent relative to the gun is important. In order to maintain a desired vent location, the lid and yolk of the lid assembly are prevented from rotating relative to the paint feed tube secured to the gun. A wrench is required in order to secure the paint cup lid assembly to the spray gun and to remove the lid assembly from the spray gun. At times, it is desirable to be able to attach the lid assembly to a spray gun or to remove the cup and lid assembly from the spray gun without the use of a separate wrench.

DISCLOSURE OF INVENTION

According to the invention, a paint cup lid assembly is designed for attachment to and removal from a paint spray gun without the need for a separate wrench. The yolk for securing the lid assembly to the cup is designed so as to not rotate relative to the lid and the paint feed tube when the yolk is positioned for engaging the cup. When the cup is detached from the lid, the yolk may slide on the paint feed tube away from the lid to a position where it is free to rotate relative to the lid and paint feed tube. The portion of the yolk adjacent the paint feed tube facing the nut is formed into a socket which is shaped for engaging the nut when the yolk is moved away from the lid. Consequently, the yolk may be moved into engagement with the nut which secures the lid assembly to the spray gun. The yolk then is used as a wrench for securing the nut to or removing the nut from the nipple.

Accordingly, it is an object of the invention to provide an improved paint cup lid assembly which is easily secured to and removed from a paint spray gun without the need for a separate wrench.

Other objects and advantages of the invention will become apparent from the following detailed description of the invention and the accompanying drawings.

BEST MODE FOR CARRYING OUT THE INVENTION

Figure 1:
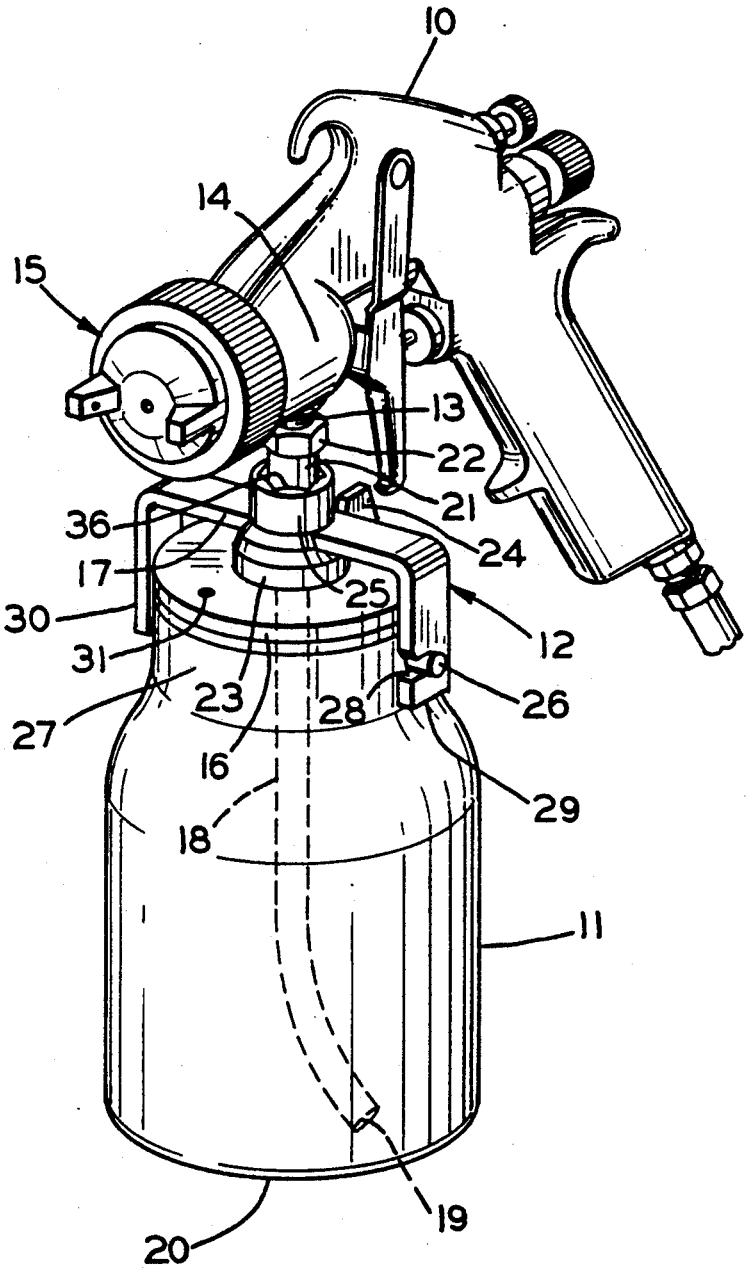
FIG. 1 is a perspective view of a paint spray gun having an attached paint cup with a lid assembly according to the invention.

Referring to FIG. 1 of the drawings, a hand held paint spray gun 10 is shown. A paint cup 11 is attached to the spray gun 10 by a lid assembly 12 according to the invention. The lid assembly 12 is attached to a threaded nipple 13 which depends from a spray gun body 14 adjacent a nozzle assembly 15. The lid assembly 12 includes a lid 16 which closes the top of the paint cup 11, a yolk 17 which is releasably secured to the cup 11, and a paint feed tube 18 which has a lower end 19 extending to adjacent a bottom 20 of the cup 11 and an upper end 21 which is secured by a nut 22 to the nipple 13.

A cam assembly 23 which includes a lever 24 is shown positioned to rotate on the paint feed tube 18 between the lid 16 and a central portion 25 of the yolk 17. Manual movement of the lever 24 in one direction rotates the cam assembly 23 to force the lid 16 away from the yolk 17 and movement of the lever in the opposite direction permits the lid to move towards the yolk 17. A pair of diametrically aligned pins 26 project from opposite sides of the paint cup 11 adjacent a cup top 27. Oppositely directed slots 28 are located on opposing side portions 29 and 30 of the yolk 17 for releasably engaging the pins 26 when the yolk 17 is rotated. The paint cup 11 is secured to the lid assembly 12 by positioning the cup 11 against the lid 16 and rotating the cup 11 relative to the yolk 17 until the pins 26 engage the slots 28. The lever 24 then is moved to force the lid 16 away from the yolk 17 until the cup is firmly clamped in place. It will be appreciated that other known constructions may be used for releasably securing together the cup 11 and the lid assembly 12.

Preferably, the lid assembly 12 is secured to the gun 10 so that the lid 16 and yolk 17 will not rotate relative to the gun 10. As illustrated, the lid assembly 12 is secured to the gun 10 so that the lower end 19 of the paint feed tube 18 extends to the rear of the cup bottom 20 and a vent 31 in the lid 16 is located towards the front of the gun 10. With this arrangement, the gun 10 may be aimed anywhere from a downward angle through a vertically upward angle without paint dripping from the vent 31.

Figure 5:
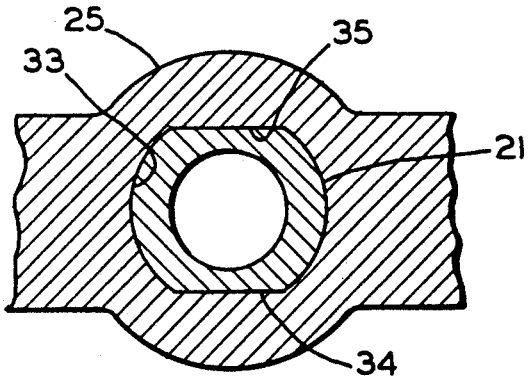
FIG. 5 is a fragmentary cross sectional view taken along line 5—5 of FIG. 3.

Turning now to FIGS. 2-6, the invention is shown in detail. The central portion 25 of the yolk 17 is generally tubular shaped, having an axial opening 32. The opening 32 has a lower portion 33 which is sized to slide on the upper end 21 of the paint feed tube 18. As best seen in FIG. 5, flats 34 are formed on a portion of the upper feed tube 21 and corresponding flats 35 are formed in the opening portion 33 to prevent rotation of the yolk 17 relative to the lid 16 when the lid assembly 12 is secured to the paint cup 11. However, the flats 34 do not extend the full length of the upper feed tube 21. Consequently, when the yolk 17 is moved away from the lid 16, the yolk flats 35 are clear of the upper feed tube flats 34 and the yolk 17 is free to rotate on the upper feed tube 21.

Figure 2:
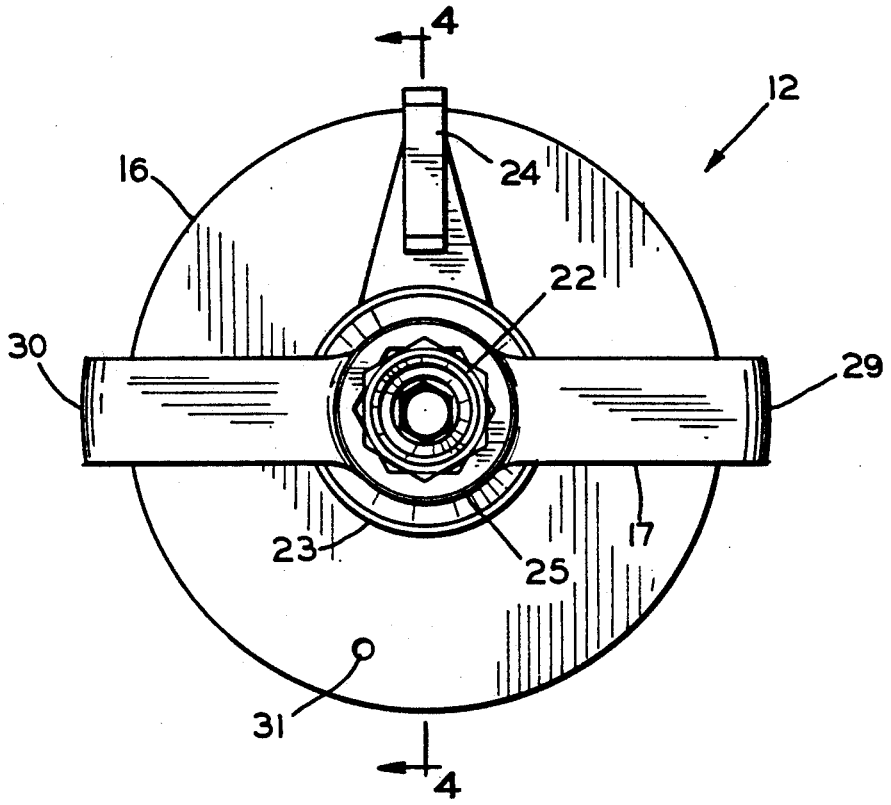
FIG. 2 is a top plan view of a paint cup lid assembly according to the invention.
Figure 3:
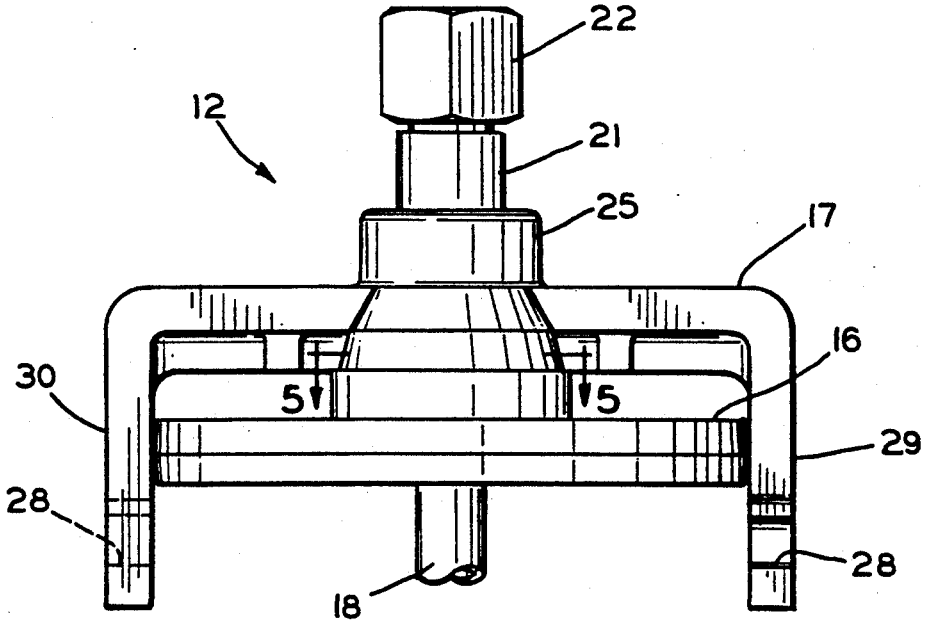
FIG. 3 is a side elevational view of the paint cup lid assembly according to the invention, with a lower portion of the paint feed tube shown in fragmentary.
Figure 4:
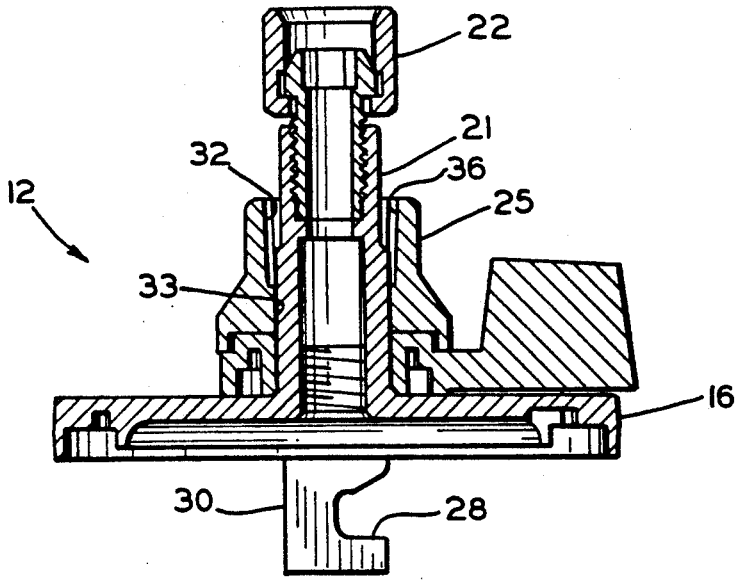
FIG. 4 is a cross sectional view taken along line 4—4 of FIG. 2, but with the lower portion of the paint feed tube omitted.

The opening 32 has an upper socket portion 36 which is shaped like a wrench socket of a size for engaging the nut 22 when the yolk 17 is moved away from the lid 16. If the nut 22 is hexagonal, the opening portion 36 may have either six points as shown in FIG. 1 or, preferably, twelve points as shown in FIG. 2 to allow the yolk 17 to engage the nut 22 in more yolk orientations. The sides of the socket portion 36 may be parallel or slightly angled so that the socket portion 36 will more firmly grip the nut 22. Or, if the nut 22 has a different exterior configuration, the socket portion 36 is suitably shaped to engage the nut 22.

Figure 6:
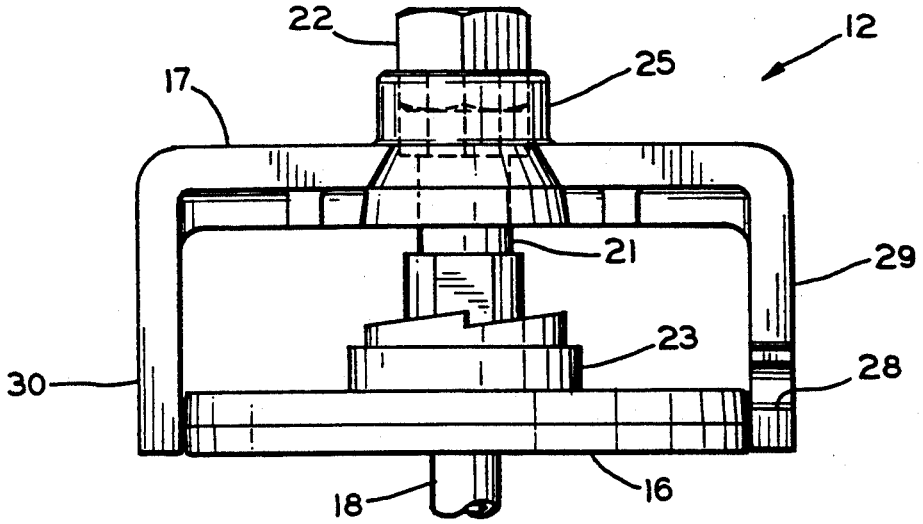
FIG. 6 is a side elevational view similar to FIG. 3, only showing the yolk raised to engage the nut.

In operation, the yolk 17 is used an integral wrench for tightening and loosening the nut 22 while the paint cup 11 is detached from the lid assembly 12. The yolk 17 is merely moved into engagement with the nut 22, as shown in FIG. 6 and the side portions 29 and/or 30 may be grasped to provide sufficient leverage to rotate the nut 22. Consequently, a separate wrench is not required for tightening or loosening the nut 22.

It will be appreciated that various modifications and changes may be made to the above described preferred embodiment of the paint cup lid assembly without departing from the spirit and the scope of the following claims.

I claim:

1. A lid assembly for a paint cup of the type including a lid for closing the paint cup, a yolk for attachment to the cup, a paint feed tube extending from said lid through an opening in said yolk to a nut for securing said lid assembly to a paint spray gun, the improvement comprising a socket formed in said yolk opening, said socket having a size and shape for engaging said nut and means on said socket for preventing rotation between said socket and said nut when said socket engages said nut.

2. A lid assembly for a paint cup, as set forth in claim 1, wherein said nut has a hexagonal shape and said socket has at least six points for engaging said nut.

3. A lid assembly for a paint cup, as set forth in claim 2, wherein said socket has twelve points.

4. A lid assembly for a paint cup, as set forth in claim 1, and including key means for preventing rotation of said yolk relative to said paint feed tube when a paint cup is attached to said lid assembly and for allowing said yolk to rotate relative to said paint feed tube when said yolk socket engages said nut.

* * * * *